United States Patent [19]

Knickerbocker

[11] 3,946,848

[45] Mar. 30, 1976

[54] COIN TOTALIZER MECHANISM

[76] Inventor: Karl Knickerbocker, 400 Baycrest Drive, Venice, Fla. 33595

[22] Filed: Sept. 5, 1974

[21] Appl. No.: 503,497

[52] U.S. Cl. ..... 194/94; 194/48; 194/DIG. 3; 194/1 L

[51] Int. Cl.[2] ..... G07F 5/00

[58] Field of Search..... 194/1 G, 1 L, DIG. 3, 18, 194/32, 37, 51, 45, 48, 94, 95, 102

[56] References Cited

UNITED STATES PATENTS

| | | | |
|---|---|---|---|
| 1,948,107 | 2/1934 | Gilchrist et al. | 194/1 G X |
| 2,991,868 | 7/1961 | Dillon | 194/95 |
| 3,081,858 | 3/1963 | Bailey | 194/102 |
| 3,738,466 | 6/1973 | Knickerbocker | 194/18 |
| 3,882,984 | 5/1975 | Knickerbocker | 194/94 |

*Primary Examiner*—Robert B. Reeves
*Assistant Examiner*—Joseph J. Rolla
*Attorney, Agent, or Firm*—Stein, Orman & Fisher

[57] ABSTRACT

A coin totalizer mechanism utilized in vending machines or the like for the purpose of providing access to the contents of a given machine upon the depositing of a predetermined amount of coins into the mechanism. A coin chute defines a common flow path through which coins of various denominations pass and are directed into engagement with a totalizer actuator element substantially in the form of a walking beam having a portion thereof positionable in driving engagement with a register. Free selective incremental advancement of the register is accomplished by actuation of the coins having predetermined coin characteristics, including size and weight, with a totalizer actuator element positionable to regulate, at least in part, movable engagement between the walking beam or a portion thereof and the register. A price setter plate is attached to and movable with the register wherein linkage is in turn attached to the price setter plate and related structure to accomplish opening of any access door or the like to allow access to or dispensing of the contents of the machine upon the totalizer mechanism determining that the proper amount of money has been deposited.

21 Claims, 12 Drawing Figures

FIG. 1
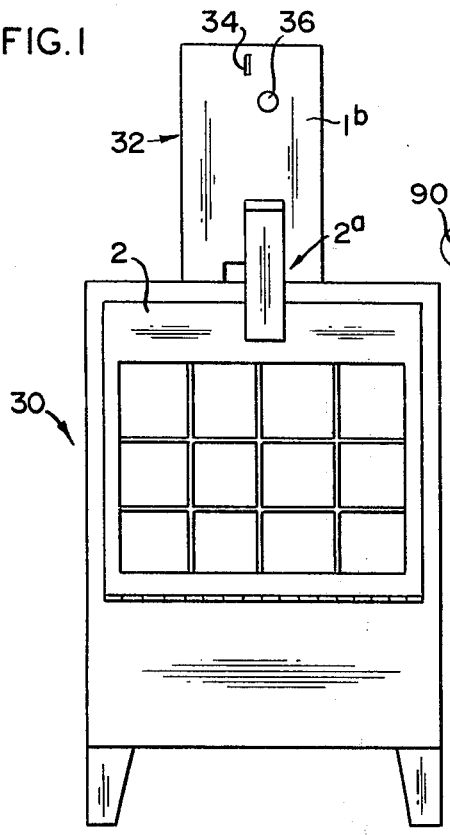
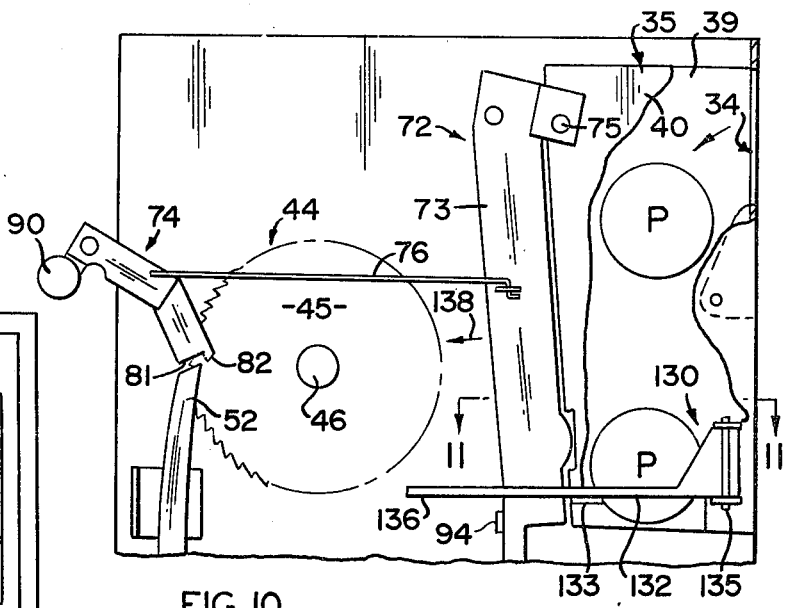
FIG. 10
FIG. 11
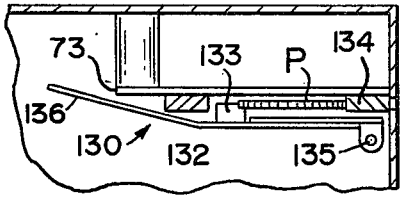
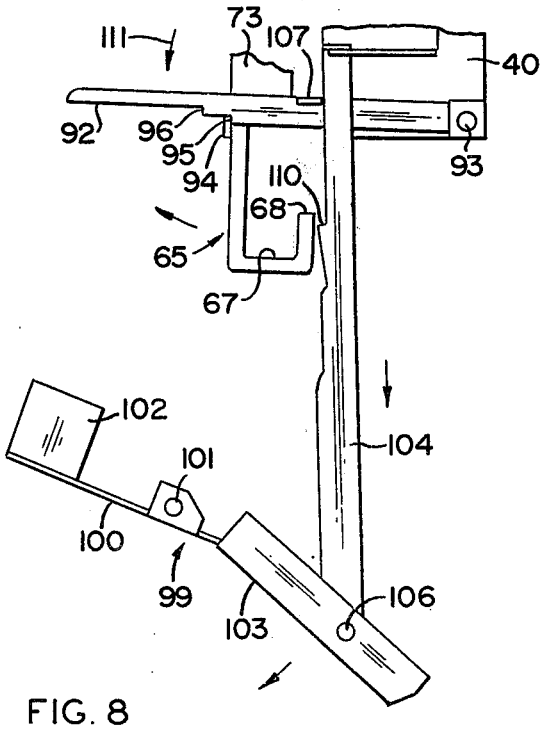
FIG. 8
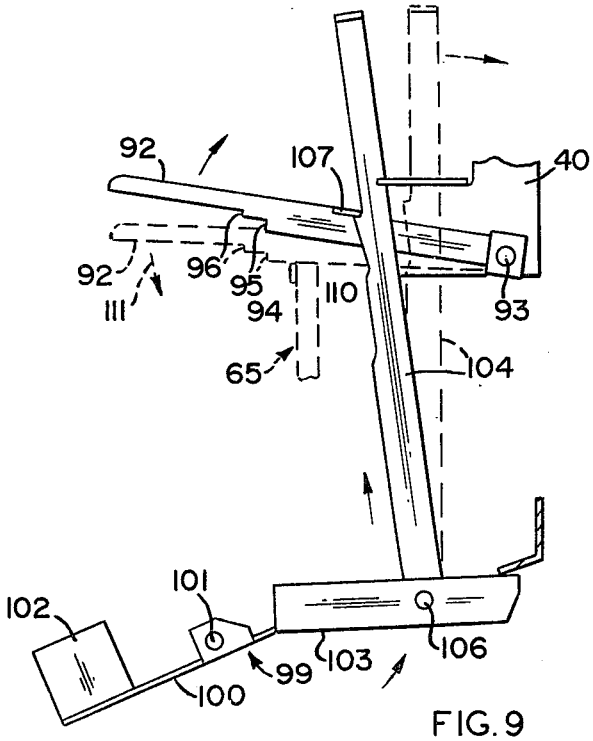
FIG. 9

COIN TOTALIZER MECHANISM

BACKGROUND OF THE INVENTION

1. Field of the Invention

A coin activated mechanism utilized for the regulating of dispensing products from a dispensing machine wherein a totalizer assembly accomplishes determination of the cumulative value of coins inserted so that access to or dispensing of a desired product may be accomplished.

2. Description of the Prior Art

In today's modern, rapid paced society, a large number and a wide variety of vending machines are being utilized for the dispensing of almost an infinite variety of goods and products to the general public. The vast majority of these types of machines are operated by means of depositing therein a preselected amount of money in the form of coins. Alternately, various checks which are similar to coins both in dimension and weight are utilized.

It is obvious that the utilization of an efficient, accurate and reliable coin totalizer mechanism is crucial in the succcess and growth of the vending machine industry. Generally, these coin mechanisms are mechanical, electrical or a combination of electro-mechanical in their mode of operation.

An increasing number of electrically actuated coin controlled vending machines are becoming available. Basically, these machines may be considered somewhat more "sophisticated" in that they are designed to vend or dispense a plurality of different kinds of brands of merchandise within a varying price range. In this type of application, electrically operated vending machines are considered to have certain advantages over mechanical vending machines. These generally relate to the factor of reliability wherein it may be considered that mechanical vending machines are more susceptible to abuse due to slamming, shaking or general rough treatment. This type of abusive treatment frequently results in mechanical failure of the mechanically operated vending machine because of the disruption of the linkage or gearing, etc. found therein.

Until recently, it is also considered that mechanical vending machines did not have the versatility to accept a wide variety of coins of various denomination in order to accomplish efficient dispensing of a product at one or more preselected prices. Accordingly, mechanical vending machines are more specifically, the coin totalizer mechanisms essentially controlling the dispensing of the product have been designed to handle a wide variety of coins deposited therein in any given sequence such that the mechanism will activate dispensing upon reaching or totalizing a predetermined quantity of money being deposited. In order to accomplish this versatility the design and structure of prior art coin totalizer mechanisms have become relatively complex thereby leading to increased rates of breakdown, less reliability and a greater expense for initial purchase and maintenance.

In accomplishing the handling of coins of different denominations and accordingly, different characteristics including weight and size, the complexity of commercially available coin mechanisms have increased with frequently questionable improved efficiency and performance in operation. Conventional prior art devices necessarily include some type of separation device wherein coins of various dimensional and/or weight characteristics are separated into separate coin passages or chutes whereby individual actuators are engaged or otherwise caused to react with some type of totalizer assembly so that the coins having the various different characteristics may be accurately registered. Dividing or separating the coins of various characteristics for the purpose of registering their denominations has been a common solution to the use of a wide variety of coins of various denominations. The disadvantages associated with such mechanisms, however, are again related to overly complex structures being both expensive, unreliable and also the very important fact that mechanisms of this type are considered to be generally bulky and take up more space than that originally intended or desired.

In addition, individual actuators have previously been required due to the fact that coin characteristics including both size and weight vary to a sufficient degree that a single actuator mechanism would be capable of handling all of the various differences in coin characteristics has previously not been found to be efficient or reliable. For instance, both the size and the weight of a dime varies greatly from the size and weight of a quarter. A common problem associated with mechanical coin mechanisms and totalizers is the fact that normally dimes or ten cent pieces have not had sufficient weight to do an adequate amount of "work" in terms of activating a mechanism to in turn register the passage of a dime through the totalizer mechanism. To the contrary, a quarter has more than enough weight to "trip" a lever-type actuator or other structural mechanism and thereby be efficiently registered with a controlling totalizer. The prior art has attempted to overcome such differernces in coin characteristics by providing different actuator mechanisms to handle the coins of varying sizes and weights. Again, this has led to overly expensive and unnecessarily complex and bulky mechanisms being commercially available which still do not have the high degree of reliability desired.

Accordingly, it is obvious that there is a need in the vending machine industry for a coin totalizer mechanism having a structure of relatively simple and efficient design capable of handling a number of coins with varying degrees of coin characteristics and also which is capable of providing high efficiency, reliability and economic feasibility.

SUMMARY OF THE INVENTION

This invention relates to a coin totalizer mechanism including a totalizer means for registering the total amount of coins deposited in a vending machine for the purpose of dispensing or rendering access to goods within the machine once a preselected total has been reached. The totalizer means includes a register means capable of incremental advancement upon the depositing and resulting registering of coins in various denominations. More specifically, a register actuator means which may be in the form of a pivotally mounted walking beam movably interconnected between a flow path of coins passing through the mechanism and the register means itself.

One end of the walking means is disposed in movable, driving relationship to a ratchet wheel comprising the register means. Another portion of the walking beam has mounted thereon a coin engaging means which is disposed contiguous or immediately adjacent to a coin chute means which at least partially defines a flow path of travel of coins as they are deposited into and passed through the coin mechanism. Engagement of the coins with the coin engaging means or "coin catch" serves to pivot the walking beam into direct driving engagement with the ratchet wheel of the register means serving to advance it a predetermined amount dependent upon the regulated displacement of the walking beam. This displacement is in turn dependent upon the denomination, or more specifically, the coin characteristic of the particular coin engaging the coin catch.

A totalizer actuator means comprises a gauge element disposed in communicating relation with the coins as they pass along the coin flow path. Coin engagement with the gauge element serves to displace the totalizer actuator means, and more particularly the stop means associated therewith, into predetermined relation relative to the register actuator means. This displacement in turn varys upon the coin characteristics (size an/or weight) and the amount of displacement regulates the position of the stop means relative to movement of the register actuator as it is drivingly engaging the register means or ratchet wheel. For example, passage of a quarter along the coin flow path would cause displacement of the totalizer actuator means and more particularly the stop means associated therewith a sufficient degree to allow greater incremental advancement of the register than if a nickle or coin having characteristics different from a quarter would pass along the coin flow path.

By virtue of this structure, a single assembly or mechanism may be utilized to activate the totalizer means through advancement of the register without separating the various coins deposited due to the differences existing in the size or weight of the coin.

Other structural features of the present invention include an orienting means normally biased into path interruptive engagement relative to the gauge element of the totalizer actuator means. The orienting means is disposed and configured to maintain the gauge element in its displaced position after engagement with a coin passing along the coin flow path. This serves to maintain the stop means in the predetermined position relative to a portion of the register actuator means in order to limit its movement as it drivingly engages the register means or ratchet wheel. This, in turn, of course limits the incremental advance of the register means dependent upon the denomination of the coin passing through the mechanism.

An orienting release means is also provided to contact the orienting means in such a manner as to cause its disengagement with the gauge element of the totalizer actuator means. Biasing means are associated with the totalizer actuator means forcing its return to its normal or original position relative to the coin chute means and the coin flow path partially defined thereby. The orienting release means is positioned in coin engaging position relative to a coin passing through the mechanism and is thereby coin actuated dependent upon the coin characteristic (weight) of the coin it engages.

A primary rejector means is operated by a push button or similar lever-type mechanism disposed at least in part on the exterior of the case in which the mechanism is mounted. This primary rejector also includes a register stop which is normally biased into engagement with the periphery of the ratchet wheel comprising the register means and which also includes a finger member serving to engage the orienting means causing its disengagement with the totalizer actuator means. This primary rejector is normally utilized to bring all of the working structural elements of the mechanism back to their initial position if for some reason the various elements become jammed, etc.

A secondary coin rejector is mounted in communicating relation with the coin flow path and is specifically disposed and configured to cause blockage of a coin of predetermined dimension from passing completely through the coin chute means or along the coin flow path. For instance, if it is desired that the mechanism should not register pennies, the secondary rejector is disposed and configured to cause blockage of the flow path relative to any penny or coin having similar size characteristics. This secondary rejector means is further configured to be dislodged out of blocking relation to the coin flow path upon sufficient displacement of the totalizer actuator means as will be described in greater detail hereinafter.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention reference should be had to the following detailed description taken in connection with the accompanying drawings in which:

FIG. 1 is a front view of a typical vending machine and mechanism casing in which the totalizer mechanism is mounted.

FIG. 8 is a detailed view of the orienting means and orienting release means in working relation to one another.

FIG. 9 is a detailed side view of the orienting means and orienting release means shown in engaged relation to one another for release of the totalizer actuator means.

FIG. 10 is a side fragmentary view of the totalizer actuator means and the secondary rejector means disposed relative thereto.

FIG. 11 is a top sectional view taken along line 11—11 of FIG. 10 showing the relation of the secondary rejector means to the coin chute means and coin flow path defined thereby.

Similar reference characters refer to similar parts throughout the several views of the drawings.

DETAILED DESCRIPTION

Figure 2:
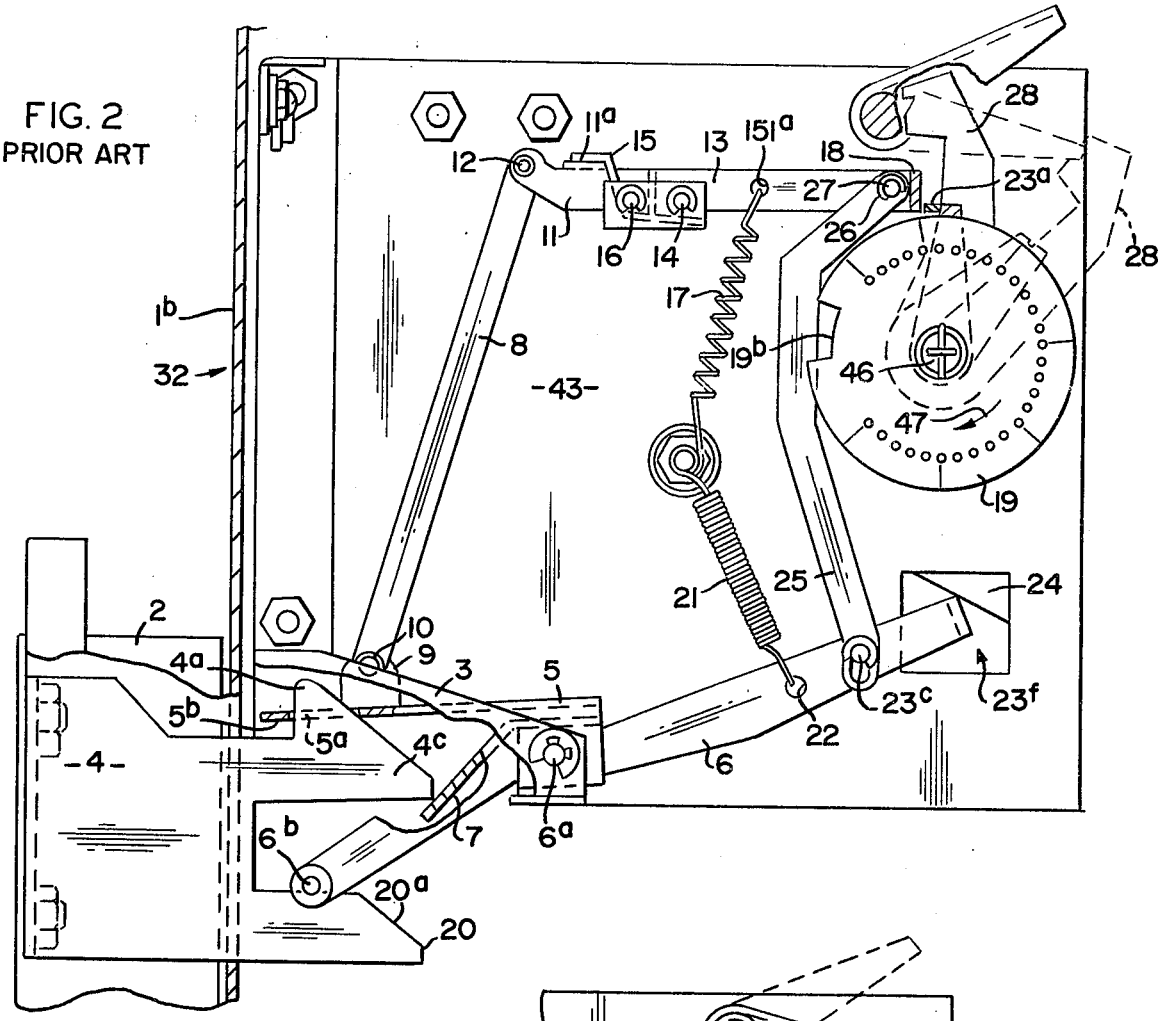
FIG. 2 PRIOR ART
FIG. 2 is a fragmentary detail view of the totalizer means including the price setter plate and associated linkage serving to release the opening or door providing access to or dispensing of the products within the vending machine.
Figure 2A:
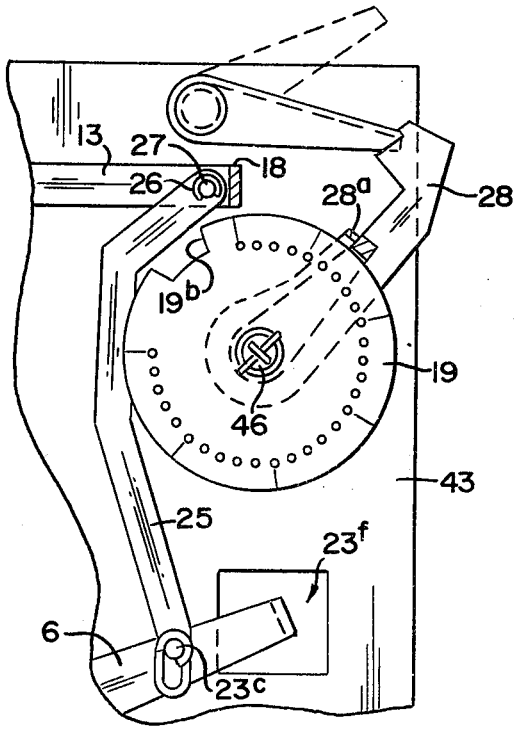
FIG. 2A PRIOR ART
FIG. 2a is a fragmentary detail view of the price setter plate and associated linkage.

The present invention is directed to a coin totalizer mechanism designed to be used in combination with vending machines generally represented as 30 in FIG. 1. A coin mechanism casing 32 is mounted on top thereof and is interconnected by virtue of the structural features of the coin mechanism itself to door extension generally indicated as 2. A coin slot 34 is formed in the front wall 1*b* of housing 32 and is disposed to provide various coins of predetermined denomination passing into a coin chute means generally indicated as 35 to be explained in greater detail hereinafter. A primary rejector button 36 is also mounted for access on the front wall 1*b* of casing 32 and is interconnected to the remainder of the mechanism for the purpose of dislodging jammed coins or the like as also will be explained in greater detail hereinafter. The coin totalizer mechanism which comprises a major portion of the present invention is connected to the totalizer structure and linkage resulting in the release of door 2 upon the depositing of a predetermined amount of money in the form of coins of various denominations. Structure shown in FIGS. 2 and 2*a* is representative of such a totalizer structure and accompanying linkage which serves to unlock door 2 thereby rendering access to the products in the vending machine 30. This type of totalizer structure and accompanying linkage may be similar to that structure disclosed and claimed in U.S. Pat. No. 3,733,466 to Knickerbocker. For the purpose of clarity and explanation, the structural features as shown in FIGS. 2 and 2*a* will be hereinafter explained in detail. It should be further noted, however, that the scope of the present invention is not intended to be limited to the structure shown in FIGS. 2 and 2*a* and applicable totalizer structure fitting within the structural parameters of the present invention could be utilized.

Referring to FIG. 2 of the drawings, the coin mechanism of this invention is shown mounted on the front inside wall 1*b* of a newspaper rack coin mechanism housing, to conserve space, the rack housing part of the drawing is a fragmentary section. The newspaper rack's door extension 2 and the coin mechanism angle plate extension 3 have been cut away in a manner that the rack door latch hook plate 4 and coin mechanism's latch plate 5, also the front portion of the coin mechanism's ratchet plate return crank plate 6, can be viewed. It will be noted that the left end of latch plate 5*b* has dropped over the hook section 4*a* of door latch hook plate 4, the rectangular slot 5*a* in latch plate 5 makes the latching possible. Plate 7 is rigidly secured to the inside top wall of latch plate 5 and extends downward from that point on an angle and comes in contact with a section of the door latch hook plate 4, to rock the latch plate 5 counter-clockwise on its mounting shaft 6*a*. When latch plate 5 is rocked clockwise, connecting link plate 8 having its lower end secured to a tab 9 on the top front end of latch plate 5 by shoulder stud 10 and the top end secured to hinge plate 11 by shoulder stud 12. Hinge plate 11 is swingably mounted to channel section of plate 13 by shaft 14, 11*a* of plate 11 is a tab formed outward at a right angle to the plate this tab normally rests on the top outer left end of plate 13 and limits the downward travel of the left end of plate 11 that is being biased by tortional spring 15. Tortional spring 15 is mounted around shaft 14, between the channel shaped walls of plate 13. The lower end of the tortional spring 15 is anchored to plate 13 and the opposite end rests against tab 11*a* of plate 11. Plate 13 is swingably mounted on shoulder stub 16 that in turn is rigidly secured to the coin mechanism base plate, and expansion spring 17 having the upper end anchored to plate 13 through an opening 151*a* and the lower end secured to a shoulder stud that is rigidly rivited to the coin mechanism base plate, biases plate 13 to rock on its pivot stud 16 clockwise. The clockwise travel of plate 13 is limited by link plate 8 being anchored to latch plate 5 that in turn has its clockwise travel limited by angle plate 7, that is a part of the latch plate 5 coming to rest against a section of latch hook plate 4. The extreme right end 18 of plate 13 is formed outward at a right angle to the plate and extends over the top side of the price setter plate.

When the paper removable door 2 is swung outward, the latch hook plate that is secured to the door extension moves away from latch plates 5, angle plate extension 7 and allows the latch plate 5 to rock on its mounting shaft 6*a* clockwise. It is obvious that the clockwise movement of the latch plate 5 will permit angle section 18 of plate 13 to come to rest on the top edge of the price setter plate 19, thus stopping the clockwise travel of the extreme left end of the latch plate 5*a*, therefore preventing the latch plate 5 from disengaging latch hook 4*a* of latch hook plate 4. It will be noted that the price setter plate 19 in this instance is set to accommodate a 35 cent sale. It will therefore be necessary to insert thirty five cents into the coin mechanism, to rotate the price setter plate 19 clockwise to position opening 19*b* of the price setter plate directly under angle section 18 of plate 13. With the price setter plate 19 in this position, angle section 18 of plate 13 will enter opening 19*b* of the price setter plate 19, therefore, when the top of the paper removal door is swung outward the added clockwise travel of plates 11, 13 and linkage 8 will permit section 5*a* of latch plate 5 to disengage section 4*a* of the door latch hook plate 4 and release the door. When the paper removal door is swung open, the price setter plate is returned to normal position as shown in FIG. 2 of the drawings to be described hereinafter. A crank plate 6 is swingably and coaxially mounted on the coin mechanism base plate by shoulder stud shaft 6*a* that in turn is rigidly secured to the base plate section of crank plate 6 and extends on a horizontal plane from each side of the channel shaped mounting section, of the crank plate (not shown). Shoulder stud 6*b* is rigidly secured to the left end of crank plate 6 and extends inward to pass over section 20 of door latch hook plate 4. Crank plate 6 is biased to swing counter-clockwise by expansion spring 21 that has the lower end anchored to crank plate 6 through opening 22, the upper end is anchored to shoulder stud. When the top of paper removal door is swung outward, shoulder stud shaft 6*b*, that is riding on section 20 of door latch hook plate 4, will follow the ramp shape section 20*a* of the plate and swing downward the right end of the crank plate will be swung upward is a section of crank plate that is formed inward from the plate at right angles to the plate, to pass through opening 23*f* of the coin mechanism base plate and under section of the stationary ratchet pawl 24 that is mounted on the opposite side of the base plate. By referring to FIGS. 8 and 9, it will be obvious that the ratchet and price setter plates that are held in their rotated positions by the stationary ratchet pawl 120 will be released. However, inasmuch as angle section 18 of plate 13 has dropped into opening 19*b* of the price setter plate 19, it will prevent the return of the ratchet and price setter plate to normal position. Therefore, connecting link plate 25 that has the top end connected to plate 13 by shoulder stud 26 and E washer 27 and the lower end connected to crank plate 6 by shoulder stud 23*c* will rock plate 13 counter-clockwise, angled section 18 of plate 13 will move out of opening 19*b* of the price setter plate 19. Thus, the plate 19 will return to normal position. These plates are biased by a tortional type clock spring that will be outlined in detail later on in the specification.

When the paper removal door 2 is closed, shoulder stud 6*b* of crank plate 6 will come in contact with the ramp 20*a* of door latch hook plate 4 and force that end of crank plate, that was lowered by the opening of the door 2, upward to normal position. The opposite end of crank plate 6 will move downward and release the stationary ratchet pawl 24. Section 5*a* of latch plate 5 will come in contact with the ramp 4*c* of the door latch hook plate 5 and cam that end of the latch plate, that was lowered by the opening of door 2 upward to normal position. It will be obvious that it will be necessary for the outer left end of hinge plate 11 to swing upward on pivot shaft 14 inasmuch as angle section 18 of plate 13 that is a part of that assembly will come to rest on top edge of price setter plate 19, as the door 2 latch hook plate moves inward it will come in contact with plate 7 of latch plate 5 and rock the latch plate counter-clockwise into latched or normal position.

Referring to FIG. 2*a* of the drawings in FIG. 2 of the drawings the price setter dial is shown set to accommodate a 35 cent Sunday newspaper sale. In FIG. 2*a*, the price setter dial assembly has been rotated manually with the quick set components 28, 28*a* and to accommodate a 15 cent daily newspaper sale. The quick change components can also be arranged in a manner, that they can be operated by remote control (not shown) from the outside of the coin mechanism housing without departing from the spirit of the present invention.

Figure 3:
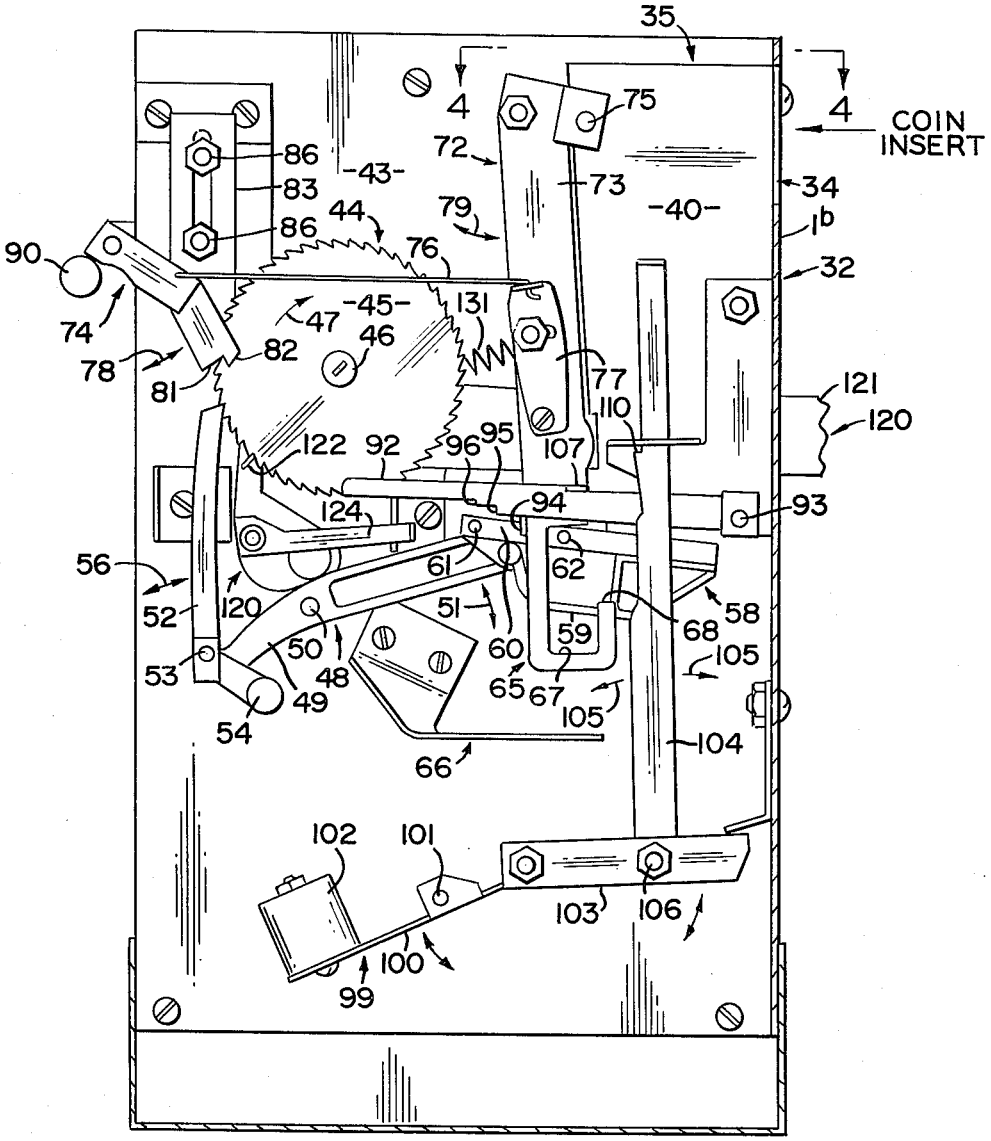
FIG. 3 is a front view of the various structural elements comprising the main working portion of the coin totalizer mechanism of the present invention.
Figure 4:
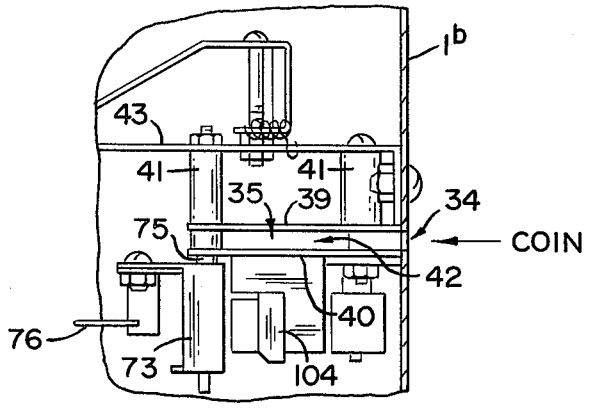
FIG. 4 is a top view taken along line 4—4 of FIG. 3 showing details of the coin passage means and coin flow path defined thereby.

Referring to FIG. 3, the coin mechanism of the present invention comprises coin slot or insert 34 disposing in communicating relation with coin chute means generally indicated as 35 which includes a pair of side walls 39 and 40 arranged in substantial parallel relation to one another (FIG. 4). The space 42 defined therebetween may be termed the coin flow path since coins passing into slot 34 are specifically directed along the path 42 by virtue of the locations of the side walls 39 and 40. A conventional connector and bushing 41 is interconnected to a portion of the casing 43. Totalizer means comprises register means generally indicated as 44 in the form of a ratchet wheel 45 rotatably mounted to casing by means of shaft 46. Ratchet wheel 45 is fixedly attached to shaft 46 and also interconnected to price setter plate 19 by virtue of the fact that shaft 46 is fixedly connected to price setter plate 19 on the opposite side of casing plate 43. In operation, advancement in predetermined increments of ratchet wheel 45 in a clockwise direction as indicated by directional arrow 47 serves in turn to rotate price setter plate 19 in the same direction until the desired total is reached as indicated on price setter plate 19. The linkage is thereby activated as described with reference to FIGS. 2 and 2*a* to release door 2 of the vending machine. Advancement of register means 44 occurs by driving engagement of ratchet wheel 45 with register actuator generally indicated as 48. The register actuator means comprises a walking beam structure 49 mounted to movably pivot about pin 50 in the direction indicated by directional arrow 51. One portion of the walking beam comprises a lever arm 52 pivotally connected to the remainder of the walking beam 49 by virtue of pivot pin 53. A lever arm biasing means 54 is disposed and configured relative to lever arm 52 to cause it to be directed into normal biasing relation relative to the outer periphery of ratchet wheel 45 as shown in FIG. 3. Pivotal movement of the walking beam 49 in the direction indicated by directional arrow 51 causes a similar pivotal movement of lever arm 52 about pivot point 53 in the direction indicated by directional arrow 56.

Figure 5:
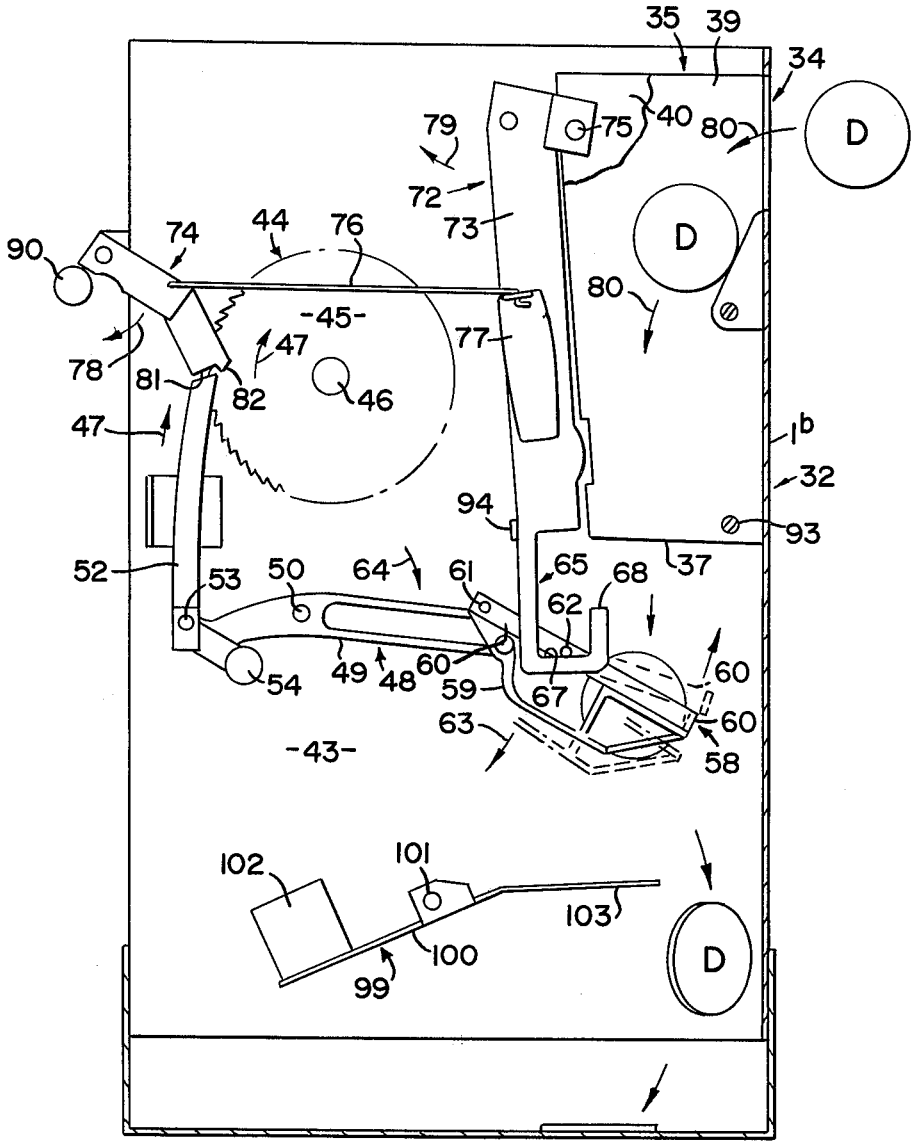
FIG. 5 is a fragmentary side view of the inner workings of the totalizer actuator means and register actuator means serving to advance the register means upon insertion of a coin of predetermined denomination.

The register actuator means further comprises a coin engaging means generally indicated as 58. This coin engaging means comprises a catch means 59 pivotally connected to the remainder of walking beam 49 at pivot pin 61. It is important to note that the catch means 59 is configured and disposed relative to the lower portion (as shown in FIG. 3) of coin chute means 35 and the defined coin flow path 42 to engage or receive coins of varying coin characteristics. More specifically, the catch means 59 is configured to receive any denomination coin irrespective of its size and weight as it passes along the coin flow path 42 and leaves the lower portion 37 (FIGS. 5 through 7) of coin chute means 35. A release means 60 is pivotally attached at 61 to catch means 59 and is specifically positioned to maintain the coin received in the catch means 59 until the release means 60 is moved to its release position. This is accomplished by release pin 62 engaging a positioner means as shown in detail with reference to FIGS. 5, 6 and 7.

The positioner means generally indicated as 65 comprises a block, stop or like element positioned in interruptive relation to pin 62. This thereby causes its pivotal movement about pin 61.

Figure 6:
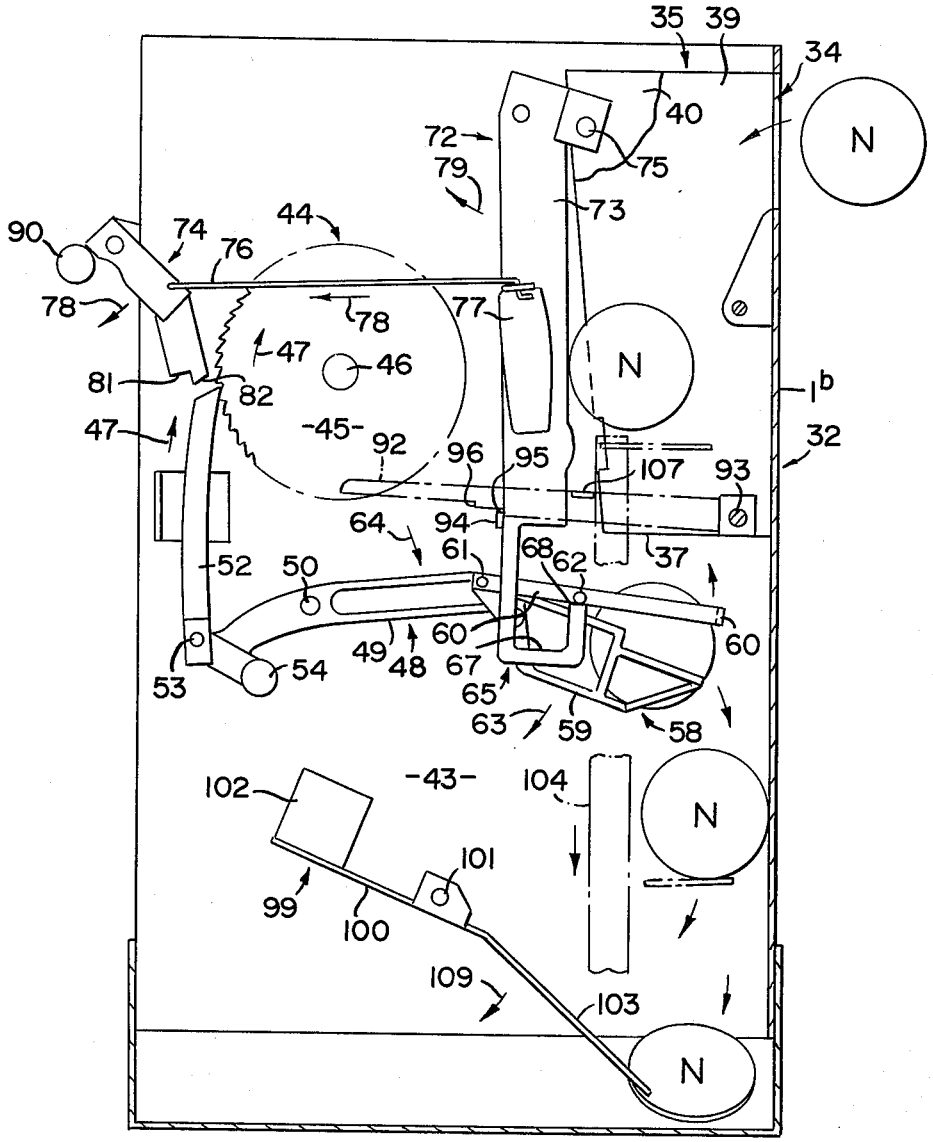
FIG. 6 is a fragmentary side view of the structural elements shown in FIG. 5 wherein a coin of different predetermined denomination is passing through the mechanism.
Figure 7:
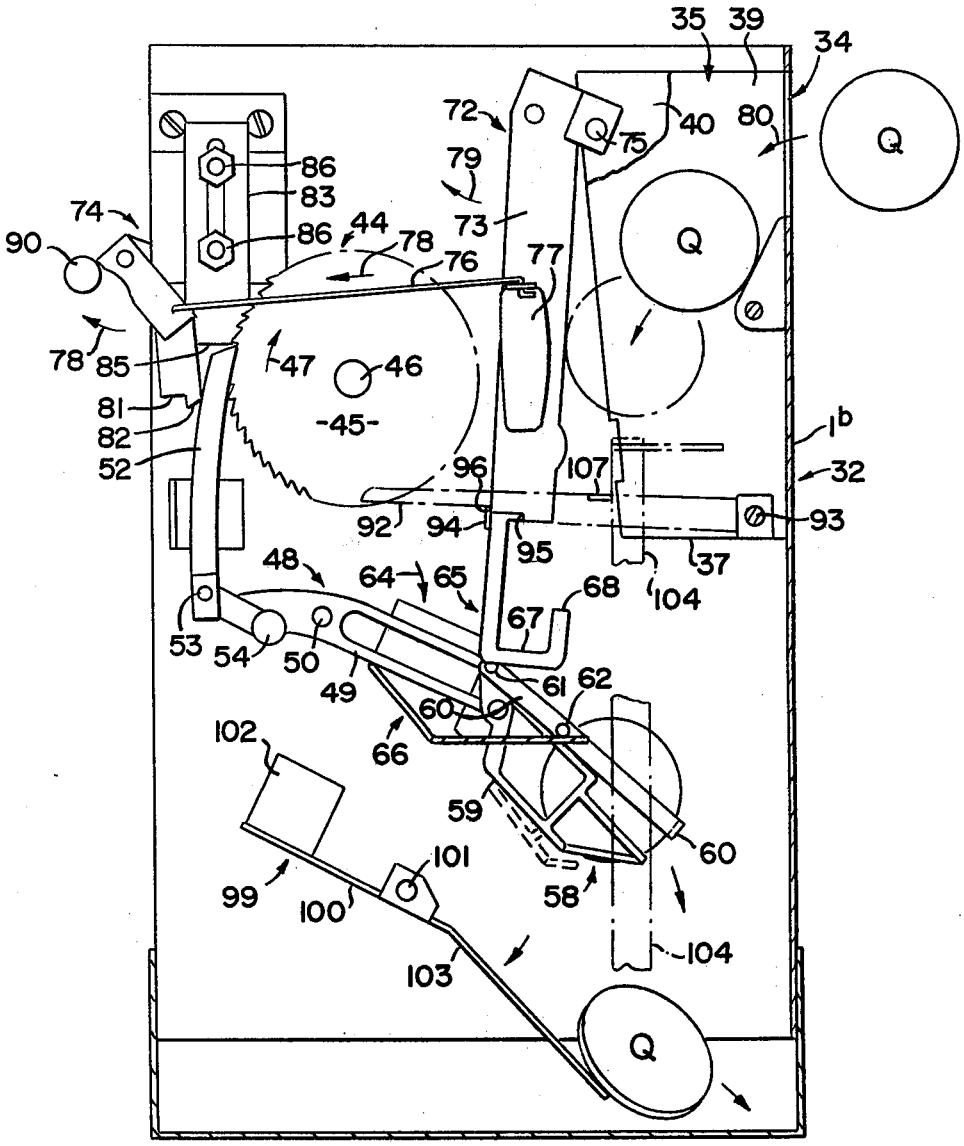
FIG. 7 is a fragmentary side view of the structural element shown in FIGS. 5 and 6 wherein a coin of yet a different predetermined denomination and accordingly coin characteristics is passing through the coin mechanism.

In operation, and with reference to FIGS. 3, 5, 6 and 7 the receiving of a coin in catch element 59 causes its pivotal movement in the direction indicated by arrow 63. This, in turn, of course causes pivotal movement of walking beam 49 in the direction indicated by arrow 64 about pivot point 50. This, in turn, causes the upward movement of lever arm 52 bringing it into driving engagement with the outer periphery of ratchet wheel 45. Ratchet wheel 45 is thereby advanced a predetermined incremental amount dependent upon the denomination of the coin passing through coin chute means 35 defining the coin flow path, as will be explained hereinafter. Upon the downward movement of catch element 59, release pin 62 engages positioner means. The positioner means has at least a first and second portion indicated as 65 and 66 (FIGS. 3 and 7) respectively. First portion of positioner means 65 includes a plurality of blocks 67 and 68 which are respectively positioned into interruptive engagement relative to the travel of release pin 62 dependent upon the position of gauge element 73 as also will be explained hereinafter. The second portion of positioner means 66 is stationary and serves to engage release pin 62 when positioner means 65 is out of path interruptive position relative to release pin 62 as shown in FIG. 7. As briefly explained above, the walking beam 49 and more particularly lever arm 52 serves to advance ratchet wheel 45 a predetermined amount dependent upon the denomination of the coin and more particularly, the coin characteristics (size and weight) of the coin being deposited. This preselected incremental advancement is accomplished through actuation of the totalizer actuator means generally indicated as 72 and includes a gauge element 73 and a stop means 74. The gauge element and stop means are interconnected by linkage 76 or any other conventional connector element so as to move or be displaced a proportionate amount simultaneously with one another. The gauge element comprises an elongated member positioned contiguous or adjacent to the coin chute means 35 and in coin engaging relation to the coin flow path defined thereby. The gauge element is pivotally mounted as at 75 so as to accomplish displacement away from the coin flow path as it engages a coin of predetermined coin characteristics (size). By virtue of connector link 76 attached to engagement element 73 by connector plate 77, the stop means 74 is movably displaced into a predetermined position in the same direction as the gauge element 73 as indicated by directional arrows 78 and 79 respectively. It can be seen from a review of FIGS. 5, 6, and 7 that the particular size of coins passing through coin chute means 35 serve to position or displace gauge element 73 a predetermined amount relative to the coin chute means 35 and coin flow path defined thereby. Specifically, with reference to FIG. 5, the coin characteristic or size of a dime passing along the flow path in the direction indicated by arrow 80 does not engage gauge element 73 and therefore does not cause any displacement of gauge element 73. In turn, stop means 74 is not displaced and one of a plurality of stop elements 81 is positioned in path interruptive relation to lever arm 52 as it drivingly engages ratchet wheel 45 in the direction indicated by arrows 47. Similarly, as shown in FIG. 6, a nickle passing along the coin flow path will engage gauge element 73 causing its displacement a predetermined amount. Accordingly, the stop means as shown in FIG. 6 will also be displaced simultaneously a related amount such that stop element 82 comprising the plurality of stop means 72 will be positioned in path interruptive relation to lever arm 52 thereby limiting the incremental advancement of ratchet wheel 45 as it is drivingly engaged by the lever arm 52.

With reference to FIG. 7, the coin characteristics (size) of a quarter passing along the coin flow path will, upon engagement with gauge element 73 cause its displacement even a greater amount so that stop elements 81 and 82 will be positioned out of interruptive relation to lever arm 52 allowing it to continue its driving engagement with ratchet wheel 45. This driving rotation of wheel 45 will continue until lever arm 52 engages stationary stop element 83 which will then be positioned in path interruptive relation relative to the lever arm 52. By virtue of connectors 86 supportingly engaging stationary stop element 83, this element can be adjusted or adjustably positioned relative to the lever arm 52 so as to allow versatility in determining preselected incremental advancement of the ratchet wheel 45 upon engagement with the lever arm 52.

Actuator biasing means 90 in the form of a weight is attached to the stop means 74 and is disposed and configured to normally bias gauge element 73 into coin engaging relation relative to the coin flow path and the coin chute means 35. Again, this biasing force exerted on gauge element 73 is accomplished by virtue of the interconnection between stop means 74 and gauge element 73 through connecting links 76.

In order to accomplish proper disposition of the stop means 74, an orienting means 92 is movably attached to the casing at 93 and includes an elongated leg member normally biased, by virtue of its inherent weight into sliding engagement with extending finger 94 formed on gauge element 73. A plurality of orienting stops 95 and 96 are integrally connected to orienting means 92 and disposed in path interruptive position relative to finger 94 as gauge 73 is displaced outwardly or further from coin passage means 35 and the coin flow path defined thereby. As shown in FIGS. 6 and 7, the path of a nickle and a quarter or any coins of varying coin characteristics (size) serves to displace the gauge element 73 a predetermined, different distance from the flow coin path. This, of course, is due to the configuration and disposition of the chute passage means 35 and the relative position of gauge element 73 thereto.

In order for stop means 74 to accurately regulate the movement of lever arm 52 as it drivingly engages ratchet wheel 45, the preselected stop element 81 or 82 must be maintained in position to engage the top portion of lever arm 52 a predetermined amount of time to allow for the coins to pass from the point where it engages gauge 73 to the point where it is caught by catch element 59. This maintenance of stop means in its displaced position is caused by the finger engaging either of the stop elements 95 or 96 while the coin is allowed to pass downwardly and activates the walking beam 49 through its engagement with the coin.

Referring to FIGS. 8 and 9, once the coin passes from the catch element 59 it engages the orienting release means 99 comprising a pivotally mounted member 100 having biasing means 102 attached thereto and also including a platform 103 disposed in coin engaging relation to the coin flow path. An upwardly extending pivot shaft 104 is attached to the orienting release means 99 and due to its pivotal motion about point 106 it serves to engage projecting flange 107 integrally formed on orienting means 92.

With specific reference to FIGS. 8 and 9, a coin passing either directly from the coin passage means 35 along the flow coin path or alternately from the catch element 59 serves to fall on platform 103. This, in turn, causes pivotal movement of member 100 about point 101 as best shown in FIG. 6. Movement of platform 103 downwardly as indicated by directional arrow 109 causes pivotal movement of pivot shaft 104 as indicated by directional arrows 105. This pivotal movement serves to displace pivot shaft 104 into engagement with finger 107 as shown by the sequence in FIGS. 8 and 9. Upon engagement with disposed ledge 110 with finger 109 orienting means 92 which is normally biased in the direction indicated by arrow 111 then serves to be lifted from engagement with finger 94 on gauge element 73 causing disengagement therebetween and automatically return of gauge element 73 and interconnected stop means 74 into the normal coin engaging position relative to the coin flow path and coin passage means 35.

Additional structural features of the present invention include a primary rejector means generally indicated as 120 and including a push button or like lever 36 disposed at least in part on the exterior of casing 43. The primary rejector includes a register stop 122 which is normally biased into engagement with the periphery of ratchet wheel 45 by a biasing means 131 in the form of a spring. The primary rejector further includes a finger member 124 serving to engage the orienting means 92. The relative disposition of the orienting means 92 and the finger element 94 is such as to cause disengagement between orienting means 92 and the element 94 on the gauge means so that the totalizer actuator means may return to its normal coin engaging position relative to the coin flow path. This primary rejector is normally utilized to bring all the working structural elements of the coin totalizer mechanism back to their initial position if for some reason the various elements become jammed, etc.

Turning to FIGS. 10 and 11, a secondary coin rejector means generally indicated as 130 is mounted in communicating relation with the coin flow path and is specifically disposed and configured to cause blockage of a coin (P) of predetermined dimension from passing completely through the coin chute means 35 or along the coin flow path. To accomplish this, support arm 132 is provided in communicating relation with the coin flow path and has mounted thereon a blockage element 133 disposed and configured in cooperative relation to a portion 134 of the coin chute means which helps defint the coin flow path. The support arm 132 is pivotally mounted at 135 to the case in the communicating position relative to the coin flow path and in coin engaging position relative thereto as shown in FIG. 11. The outer extremity or at least a portion thereof 136 of the support arm 132 is disposed in path interruptive position relative to gauge element 73 upon coin engagement between the gauge element 73 and the coin (P) the gauge 73 will of course be displaced outwardly as described above and as shown with reference to directional arrow 138. (FIG. 10). This, in turn, will cause engagement between portion 136 and gauge element 73 causing the pivotal rotation of the support arm 132 about pivot point 135. Since block element 133 is secured to the support arm 132 it, in turn, will be pivoted out of blocking engagement relative to coin (P) thereby allowing it to pass through the coin mechanism automatically upon actuation or displacement of gauge element 73 in the manner described.

It will thus be seen that the objects made apparent from the preceding description, are efficiently attained, and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of of scope fo the invention, which, as a matter of language might be said to fall therebetween.

Now that the invention has been described, what is claimed is:

1. A coin totalizer mechanism of the type to be used with a vending machine: said machine comprising, a casing to which at least a portion of said coin totalizer mechanism is attached, coin chute means connected to said casing and configured to at least partially define a coin flow path; totalizer means connected to said casing and including register means, register actuator means engaging said register means in driving relation thereto and disposed at least in part in coin interruptive relation to said coin flow path; totalizer actuator means movably disposed in interruptive relation to said register actuator means and in coin engageable relation to said flow path, said totalizer actuator means comprising gauge means movably mounted in coin engageable relation to said coin flow path, said gauge means disposed for displacement relative to said coin flow path by engagement with coins of predetermined coin characteristics, said totalizer actuator means further including stop means mechanically coupled to said guage means to at least partially move therewith, said stop means disposable in movement regulating position relative to said register actuator means, whereby displacement of said guage means controls displacement of said stop means to regulate movement of said register actuator means in response to coins of predetermined characteristics.

2. A coin totalizer mechanism as in claim 1 wherein said guage means is dimensioned and configured to engage coins of predetermined size passing along said flow path, said guage means displaced relative to said coin flow path based on the individual size of the coins passing therealong.

3. A coin totalizer mechanism as in claim 1 wherein said stop means includes a plurality of stop elements disposed in predetermined relation to one another, each of said stop elements positionable in interruptive relation to said register actuator means dependent upon the disposition of said gauge means relative to said coin flow path, whereby coin characteristics determine displacement of said totalizer actuator means and the amount of advancement of said register means.

4. A coin totalizer mechanism as in claim 1 wherein said totalizer register means comprises a ratchet wheel rotatably mounted on said casing; said totalizer register means further comprising lever arm means positioned in driving engageable relation with said ratchet wheel whereby advancement of said register means through driving engagement with said register actuator means is determined by the disposition of said stop means.

5. A coin totalizer mechanism as in claim 4 wherein said totalizer means comprises a price setter plate connected to said ratchet wheel so as to be movable therewith, whereby advancement of said price setter plate is accomplished by driving engagement of said lever arm with said ratchet wheel.

6. A coin totalizer mechanism as in claim 1 further comprising coin rejector means mounted on said casing in communicating relation to said coin flow path, said coin rejector means including blocking means disposed in blocking relation to a coin of predetermined dimension, whereby the predetermined dimensioned coin is prevented from continuing along said flow path beyond said blocking means upon engagement therewith.

7. A coin totalizer mechanism as in claim 6 wherein said coin rejector means is movably mounted on said casing and disposable into and out of coin blocking relation to said coin flow path, at least a portion of said coin rejector means disposed in path interruptive position relative to said totalizer actuator means whereby movement of said totalizer actuator means relative to said coin flow path positions said coin rejector means out of blocking relation to said coin flow path.

8. A coin totalizer mechanism as in claim 1 further comprising actuator biasing means connected to said totalizer actuator means and disposed relative thereto so as to movably bias said totalizer actuator means in coin engaging relation to said coin flow path, at least a portion of said totalizer actuator means configured to engage coins of predetermined characteristics passing along said flow path, said totalizer actuator means further configured to accomplish displacement thereof relative to said coin flow path upon engagement with coins of predetermined characteristics, against the force exerted by said actuator biasing means.

9. A coin totalizer mechanism as in claim 8 further comprising a second portion of said totalizer actuator means disposed and configured in path interruptive position relative to said register actuator means, said first and second portions of said totalizer actuator means interconnect for concurrent movement upon displacement of said first portion of said totalizer actuator means whereby coin characteristics of a coin passing along said coin flow path determines the displacement of said totalizer actuator means and the amount of advancement of said register means.

10. A coin totalizer mechanism as in claim 1 wherein said register actuator means includes coin engaging means disposed in coin engaging relation to said coin flow path, said coin engaging means disposed relative to the remainder of said totalizer actuator to cause said driving engagement between said register means and said register actuator means.

11. A coin totalizer mechanism as in claim 10 wherein said coin engaging means comprises a catch element configured to individually receive coins passing from said coin chute means, said catch element movably connected to said casing so as to travel with the received coin a predetermined distance, whereby a portion of the remainder of said registered actuator means is pivoted into driving engagement with said register means thereby causing its advancement.

12. A coin totalizer mechanism as in claim 10 further comprising release means attached to said coin engaging means and disposed and configured to maintain engagement between said coin engaging means and a coin for a predetermined displacement of said coin engaging means.

13. A coin totalizer mechanism as in claim 12 wherein said release means is movably attached to said coin engaging means and disposable between a release and non-release position.

14. A coin totalizer mechanism as in claim 13 further comprising positioner means disposed in path interruptive position relative to the path of travel of said release means, said positioner means oriented in predetermined relation to said release means whereby placement of said release means in said release position is dependent upon engagement of said positioner means with said release means.

15. A coin totalizer mechanism as in claim 14 comprising said positioner means oriented in engageable relation to said release means, whereby engagement therebetween causes movement of said release means in said release position, said totalizer actuator means movably positioned in coin engaging relation to said coin and flow path for displacement therefrom upon engagement with a coin passing along said flow path, at least a portion of said positioner means connected to said totalizer acutator means and movable therewith, said totalizer actuator means, said positioner means and said release means all being disposed in predetermined relation to one another such that the displacement of said totalizer actuator means relative to said coin flow path defines orientation of at least a portion of said positioner means relative to said release means.

16. A coin totalizer mechanism as in claim 1 further comprising orienting means movably mounted on said casing in engageable relation with said totalizer actuator means, said orienting means movably mounted on said casing in engageable relation with said totalizer actuator means, said orienting means including orienting stop means positioned to define a predetermined orientation of said totalizer actuator means upon a predetermined movement of said totalizer actuator means in engagement thereof with said orienting stop means.

17. A coin totalizer mechanism as in claim 16 wherein said orienting stop means includes a plurality of orienting stop elements each disposed in predetermined location relative to said coin flow path, said totalizer actuator means disposed in movable engagement with said orienting means and in engageable relation with said orienting stop means, whereby a corresponding predetermined number of orientation positions of said totalizer actuator means are established by engagement between said orienting stop elements and said totalizer actuator means.

18. A coin totalizer mechanism as in claim 16 further comprising orienting release means movably mounted on said casing in engaging relation to said orienting means and said orienting release means disposable in coin engaging relation to a coin passing through said mechanism, platform means disposed in substantially spaced relation to said coin flow path, whereby movement of said orienting release means is coin actuated.

19. A coin totalizer mechanism as in claim 18 wherein said orienting means is disposed relative to said totalizer actuator means and said orienting release means to be disengaged therefrom upon coin actuation of said orienting release means.

20. A coin totalizer mechanism as in claim 18 wherein said orienting release means includes release bias means disposed on said orienting release means to exert a predetermined biasing force on said orienting release means, said release bias means disposed relative to said platform means to offset displacement of said orienting release means upon engagement of said platform with a coin.

21. A coin totalizer mechanism as in claim 20 wherein said release bias means is disposed to force engagement between said orienting release means subsequent to a coin engaging said platform means.

* * * * *